US008839696B2

(12) United States Patent
Harrington et al.

(10) Patent No.: US 8,839,696 B2
(45) Date of Patent: Sep. 23, 2014

(54) MULTI-PURPOSE PAINT CAN TOOL AND METHOD

(76) Inventors: Frederick Harrington, Kissimmee, FL (US); Kent Connick, San Jose, CA (US)

( * ) Notice: Subject to any disclaimer, the term of this patent is extended or adjusted under 35 U.S.C. 154(b) by 262 days.

(21) Appl. No.: 13/539,525

(22) Filed: Jul. 2, 2012

(65) Prior Publication Data

US 2014/0000041 A1 Jan. 2, 2014

(51) Int. Cl.
*B25D 1/16* (2006.01)
*B25F 1/00* (2006.01)

(52) U.S. Cl.
USPC ..... 81/27; 7/144

(58) Field of Classification Search
USPC ..... 81/27; 7/105, 144, 151
See application file for complete search history.

(56) References Cited

U.S. PATENT DOCUMENTS 285,060 A * 9/1883 Nies ..... 7/144
3,772,781 A * 11/1973 Newman ..... 30/123
4,580,302 A * 4/1986 Barth ..... 7/152
4,624,323 A * 11/1986 Burrola ..... 173/90
5,461,900 A * 10/1995 Gutierrez ..... 72/479
6,574,816 B2 * 6/2003 Yu Chen ..... 7/100
7,028,874 B2 * 4/2006 Lin ..... 225/93
7,191,685 B2 * 3/2007 Lowther ..... 81/27
7,779,730 B2 * 8/2010 Jones ..... 81/44
2009/0025513 A1 * 1/2009 Salvino ..... 81/3.57
2009/0120243 A1 * 5/2009 Nemeth ..... 81/27
2009/0282618 A1 * 11/2009 Meyers ..... 7/144

* cited by examiner

*Primary Examiner* — David B Thomas
(74) *Attorney, Agent, or Firm* — Stephen C. Thomas

(57) ABSTRACT

A multi-purpose paint can tool for removing a paint can lid, creating paint drainage holes within the rim of the paint can, and tamping the paint can lid closed when finished painting. The multi-purpose paint can tool of the present invention generally comprises a piston shaft that is axially movable within a tubular housing. The tubular housing may comprise a can lid opening implement on its distal end. Thereafter, axial movement of the piston shaft by user interaction with a gripping knob and lid tamping implement on the distal end of the piston shaft allows at least one piercing spike at the distal end of the piston shaft to penetrate the lower rim portion of a conventional paint can. The gripping knob and lid tamping implement may then be used to tamp the lid back onto the paint can when the painting project is completed.

21 Claims, 10 Drawing Sheets

MULTI-PURPOSE PAINT CAN TOOL AND METHOD

CROSS REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention relates to painting tools or devices and their method of use and, more specifically, the present invention relates to a multi-purpose paint can tool capable of opening a conventional paint can, or any can of similar nature, forming a plurality of drainage holes within the rim of the paint can, and thereafter closing or sealing the paint can.

2. Background Art

Since the inception of conventional metal paint cans, anyone wanting to engage in a painting project has had to deal with the inherent limitations and inconvenience associated with the management of these paint cans. Generally speaking, the paint can must be opened (i.e. removal of the paint can lid) at the beginning of the painting process and subsequently the lid must be secured tightly back onto the paint can rim at the end of the painting process. These two operations are typically accomplished using two or more individual tools that must be stored, accessed, and used separately. Generally, a conventional flat blade screwdriver or specialized paint can lid opener is used to pry open the paint can lid, and a hammer, small rubber mallet or other blunt-end object is used to tamp the lid back onto the paint can rim.

In between these two steps, however, is when one of the most aggravating aspects of the painting process occurs. As the painter is accessing and using the paint from within the can, he or she must deal with the inevitable buildup of excess paint that collects in the channels disposed about the rim of the paint can as the paint brush is wiped against the can rim and cleared of excess paint. This process fills up the rim channels with an excess of paint until it spills over the confines of the rim channel and ends up dripping down the side of the paint can. The user then must deal with the cleanup of the paint running down the sides of the can by continually wiping it off with a cloth or sponge. Oftentimes, this excess paint spillage even ends up reaching the floor or drop cloth, creating a further mess.

All in all, the use of separate paint can management tools, can wiping rags, and the associated additional clean-up tasks have generally made the painting process an unpleasant chore for most people.

BRIEF SUMMARY OF THE INVENTION

The present invention overcomes the shortcomings of the prior art by providing an apparatus that may be utilized to remove the lid of a paint can, punch holes in the paint can channel, and then seal the paint can lid back onto the paint can. In this patent application, the term "paint can" refers to any can that may contain a liquid and that has a channel disposed around the top of the can, as is commonly used in paint cans. The can itself is not to be considered as a limitation or element of the invention.

The present invention is an elongate tool comprises a tubular housing, within which a piercing spike is disposed, and which further comprises a lid tamping knob. The piercing spike may be retractable into the tubular housing, and may comprise a spring-loaded ball lock which may be utilized to capture the piercing spike into a set position. The invention may further comprise a lid opening implement that may be utilized to pry the lid from the paint can in order to open the can. An alternate embodiment of the invention further comprises a hand griping element which provides an ergonomic grip, allowing the user of the invention to firmly grasp the apparatus of the invention during use.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

Figure 1:
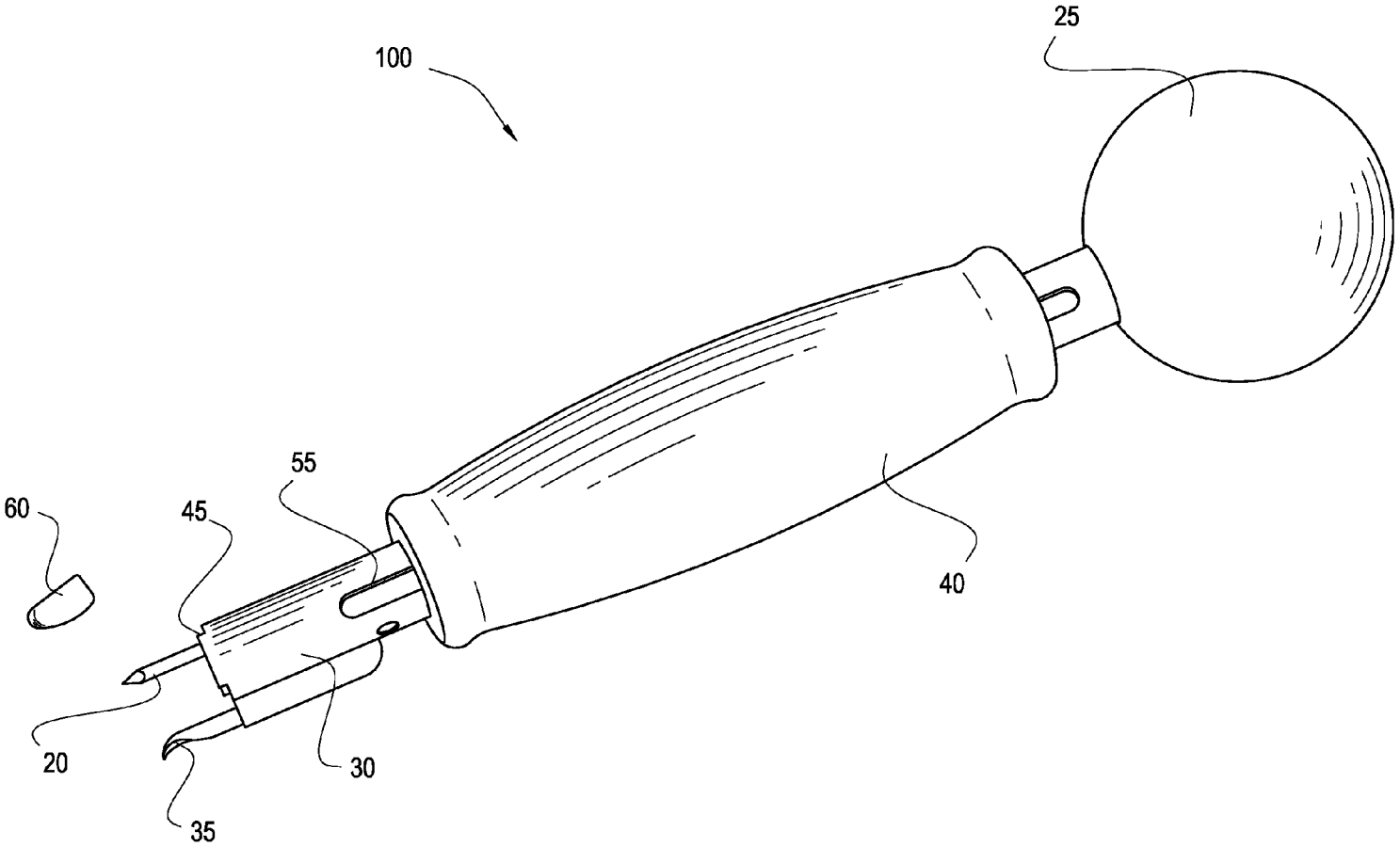
FIG. 1 depicts a side view of one embodiment of a multi-purpose paint can tool of the present invention.

The following documentation provides a detailed description of the invention.

Although a detailed description as provided in the attachments contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus the scope of the invention should be determined by the appended claims and their legal equivalents, and not merely by the preferred examples or embodiments given.

The multi-purpose paint can tool of the present invention is the first tool of its kind and has been designed for use with conventional one-quart, one-gallon and other size paint cans. Such paint cans, for example, may be fabricated of metal, a metal-plastic hybrid, plastic or other material. The material from which the paint can is made is not to be construed as a limitation of the present invention. The multi-purpose paint can tool of the invention incorporates a paint can lid opener, at least one piercing spike for punching through the paint can rim to create paint drainage holes, and a combination gripping and tamping knob to seal the lid back onto the rim of the paint can after use. Use of the present inventive tool makes the painting process easier, faster and more convenient; with much less paint can mess and less general clean-up needing to be performed.

As can be generally seen in the accompanying FIGS. 1-4, the multi-purpose paint can tool 100 may comprise two principal elements that are intended to work in combination with each other. As shown most clearly in FIG. 3, the first element may comprise a piston shaft 10 which may have an embedded spring-loaded ball lock 15, at least one piercing spike 20 at the distal end, and a dual-purpose lid tamping knob and lid tamping implement 25 (not shown) that may be affixed to the proximal end of the piston shaft 10 at threaded male end 70. The lid tamping knob may also be affixed to the proximal end of the piston shaft by any means known in the art such as welding, chemical bonding, press fit, or any other means. The second principal element of the multi-purpose paint can tool 100 may comprise a tubular housing 30 with a can lid opening implement 35 disposed at the distal end of the tubular housing 30, wherein the piston shaft 10 may slide back and forth within the tubular housing 30 after the piston shaft 10 is inserted through the proximal end of the tubular housing 30. A hand grip 40 may be disposed over the outer diameter of the tubular housing 30 to cushion or otherwise improve grasping by a user.

Figure 2:
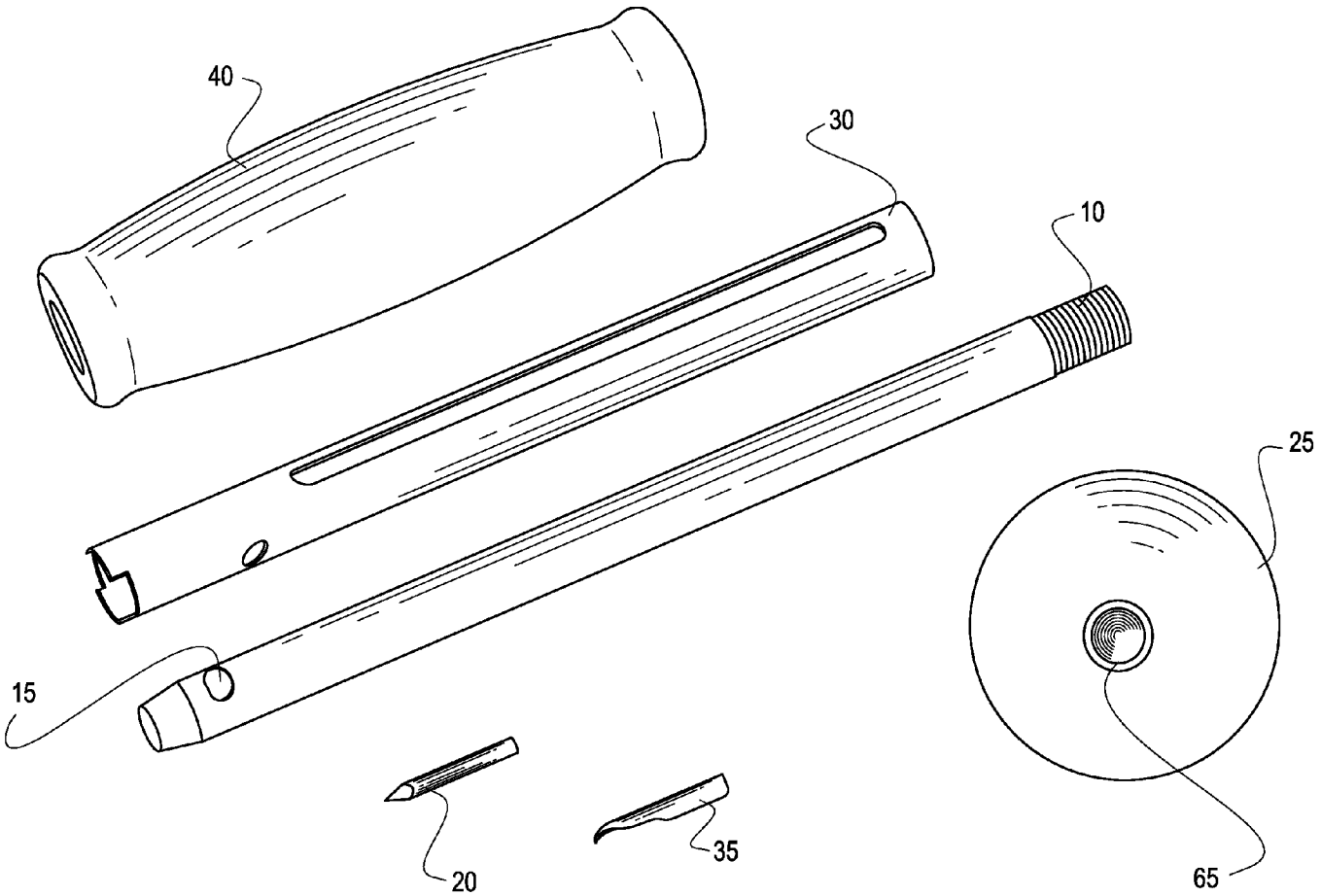
FIG. 2 depicts a perspective view of disassembled elements of one embodiment of a multi-purpose paint can tool of the present invention.
Figure 3:
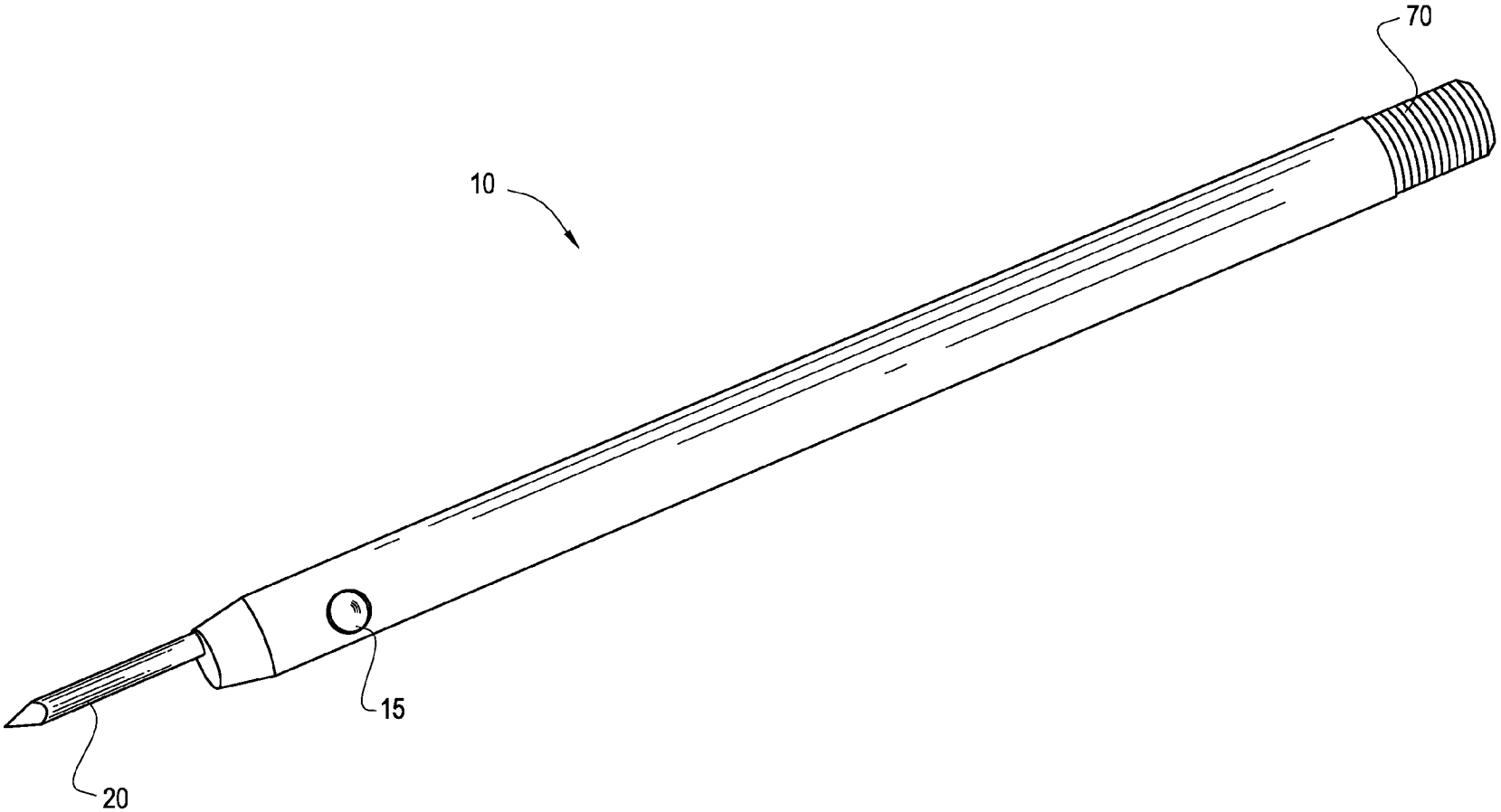
FIG. 3 depicts a side view of one embodiment of a piston shaft of a multi-purpose paint can tool of the present invention.

As shown best in FIG. 3, a preferred embodiment of a piston shaft 10 of the present invention may generally comprise a linear shaft that may comprise any cross sectional configuration, such as for example, square, rectangular, triangular, elliptical or any other cross sectional shape, that is accepted by and is axially movable within the tubular housing 30. In a preferred embodiment, the piston shaft 10 comprises a circular cross section. The distal end of the piston shaft 10 provides one portion of the functionality of the multi-purpose paint can tool 100. The distal end of the piston shaft 10 may comprise at least one piercing spike 20. As shown in FIGS. 1-3 and 9, a preferred embodiment of the multi-purpose paint can tool 100 may comprise a single piercing spike 20. The piston shaft 10 may further comprise a spring-loaded ball lock 15, wherein the spring-loaded ball lock 15 may interact with a ball lock hole 50 and a tracking guide slot 55 disposed within the tubular housing 30 as disclosed in more detail below.

The lid tamping knob 25 may be attached to the proximal end of the piston shaft 10. The attachment means may comprise any permanent or removable attachment method known in the art. In a preferred embodiment and as shown in FIGS. 2-3, the gripping knob and lid tamping implement 25 may be removably attached to the piston shaft 10 via a conventional threaded attachment method, wherein a threaded male end 70 of the piston shaft 10 may be screwed into a threaded female recess 65 disposed within the lid tamping knob and lid tamping implement 25. The complimentary male and female attachment points may be freely interchanged thereby providing a threaded female recess 65 within the distal end of the piston shaft 10 and a threaded male end 70 extending from the lid tamping knob 25 to provide a releasable attachment.

Figure 10:
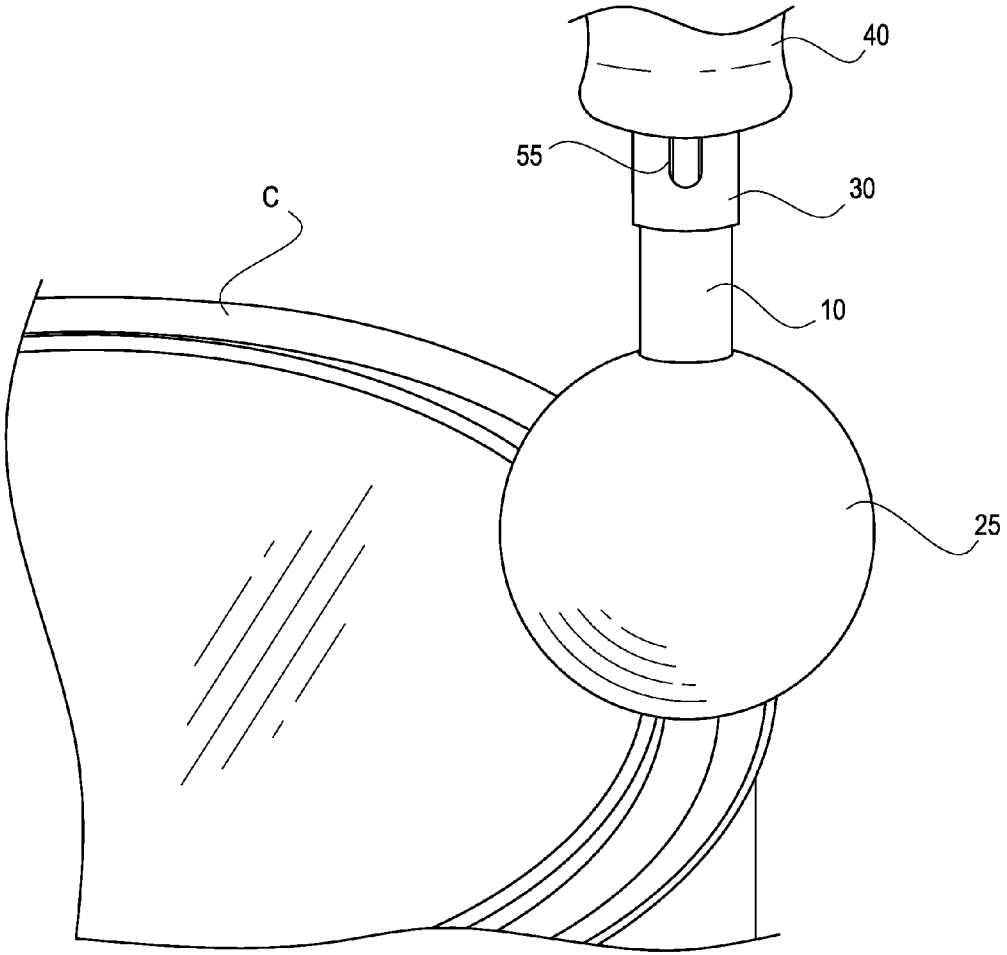
FIG. 10 depicts a perspective view of one embodiment of a multi-purpose paint can tool of the present invention in use tamping down and sealing the lid of a conventional paint can.

As shown in FIGS. 1-2 and 10, the lid tamping knob 25 may be optionally covered with a protective dampening material such as rubber or any other similarly-functioning material known within the art. This dampening material can be applied using any of a wide variety of processes that may include but are not limited to liquid material spray-coating or dipping, heat-shrinking, or other industrial rubber-coating process. In a preferred embodiment the lid tamping knob 25 may be spherically-shaped to provide an ergonomic hand grip surface for actuating the piston shaft 10 and to provide an easy-to-strike tamping surface for sealing a lid within the rim of a conventional paint can. While a spherically-shaped lid tamping knob 25 is preferred, the scope of the present invention comprises any shape configurations including but not limited to cylindrical configurations, mallet-shaped configurations, and the like.

The at least one piercing spike 20 and the lid tamping knob 25 may each independently be either molded, cast, machined, forged or cut integrally with the piston shaft 10 from one piece of raw material, or alternatively, be fashioned from a similarly wide variety of materials known within the art, and then subsequently embedded or attached to the piston shaft 10 during any of a wide variety of separate manufacturing processes. The lid tamping knob may be fabricated from hard rubber, metal, plastic or any material suitable for tamping a paint can lid in order to secure the lid onto a paint can.

Figure 4:
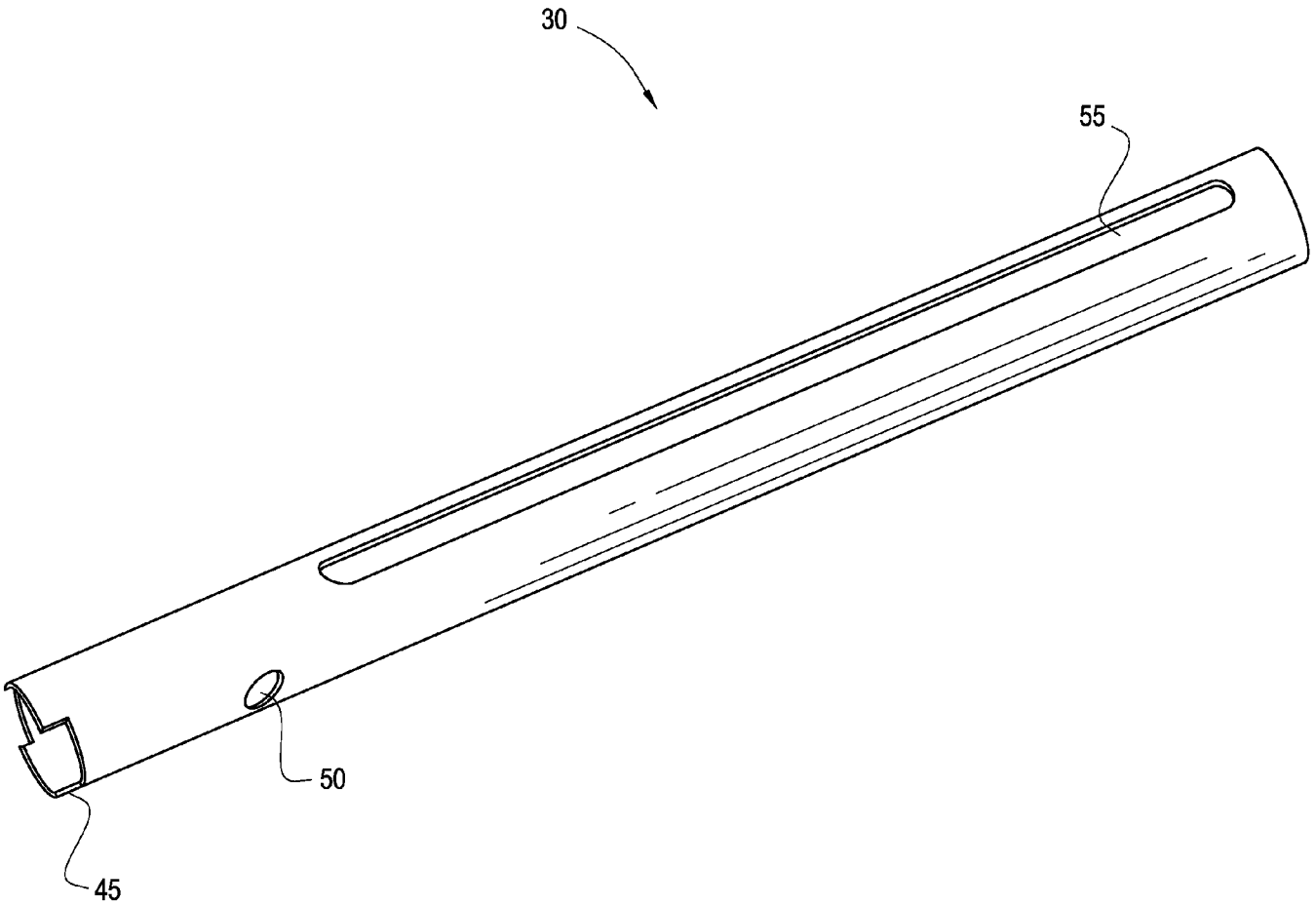
FIG. 4 depicts a perspective view of one embodiment of a tubular housing of a multi-purpose paint can tool of the present invention.
Figure 5:
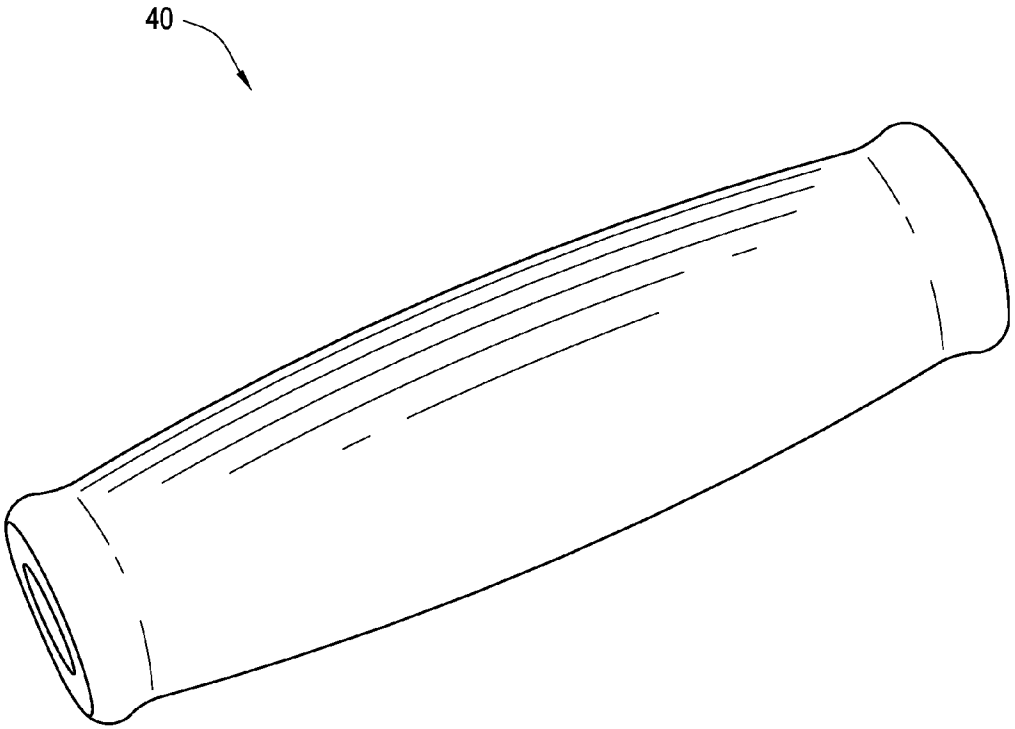
FIG. 5 depicts a perspective view of one embodiment of a hand grip of a multi-purpose paint can tool of the present invention.

As shown best in FIG. 4, the second principal element of the multi-purpose paint can tool 100 may comprise a tubular housing 30 with a can lid opening implement 35 disposed at the distal end of the tubular housing 30 (see FIGS. 1 and 6), wherein the piston shaft 10 may slide back and forth within the tubular housing 30 after the piston shaft 10 is inserted through the proximal end of the tubular housing 30. The tubular housing 30 may be notched at its distal end in such a way as to allow the at least one alignment notch 45 to lodge and secure a vertically-oriented tubular housing 30 into the upward-facing contours of a rim of a conventional paint can C (see FIGS. 7-9). The tubular housing 30 also incorporates a ball lock hole 50 and tracking guide slot 55 with which the spring-loaded ball lock 15 of the piston shaft 10 will engage to accomplish two separate functions of the tool 100 described in greater detail below. Finally, as shown in FIG. 5, a hand grip 40 may be disposed over the outer circumference of the tubular housing 30, wherein the surface of the hand grip 40 may include but is not limited to a smooth surface, a grip-enhancing textured surface, finger contours, or nubs thereon. The hand grip 40 may be made of various rubber, foam, plastic, or vinyl compositions but the scope of the present invention allows for any materials known within the art to be used.

Figure 6:
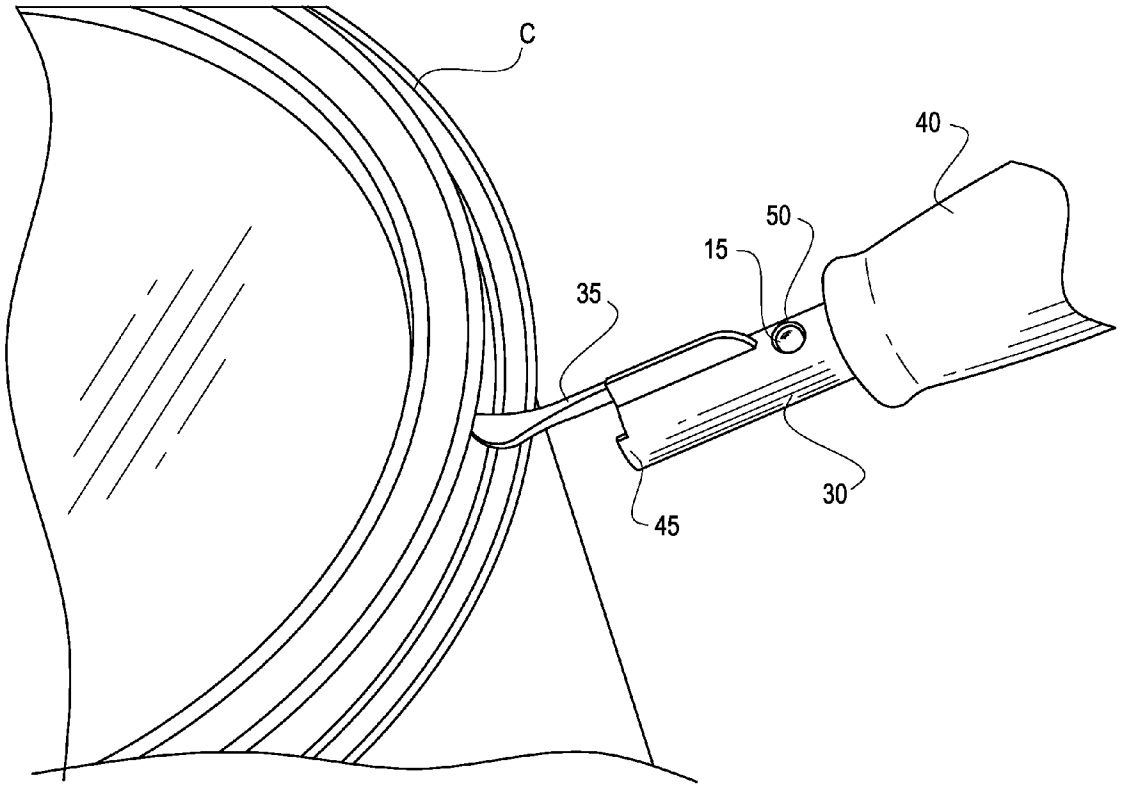
FIG. 6 depicts a perspective view of one embodiment of a multi-purpose paint can tool of the present invention in use prying open a conventional paint can.

As shown in FIGS. 1 and 6, a lid opening implement 35 disposed at the distal end of the tubular housing 30 may be used to pry open a lid that is fit onto the top of a conventional paint can C. The lid opening implement 35 may be molded, cast, machined or cut integrally with the tubular housing 30 from one piece of raw material during its formation, or alternatively, be individually-fashioned from any of a wide variety of materials known within the art, and then subsequently attached to the tubular housing 30 during any applicable separate manufacturing process.

Figure 7:
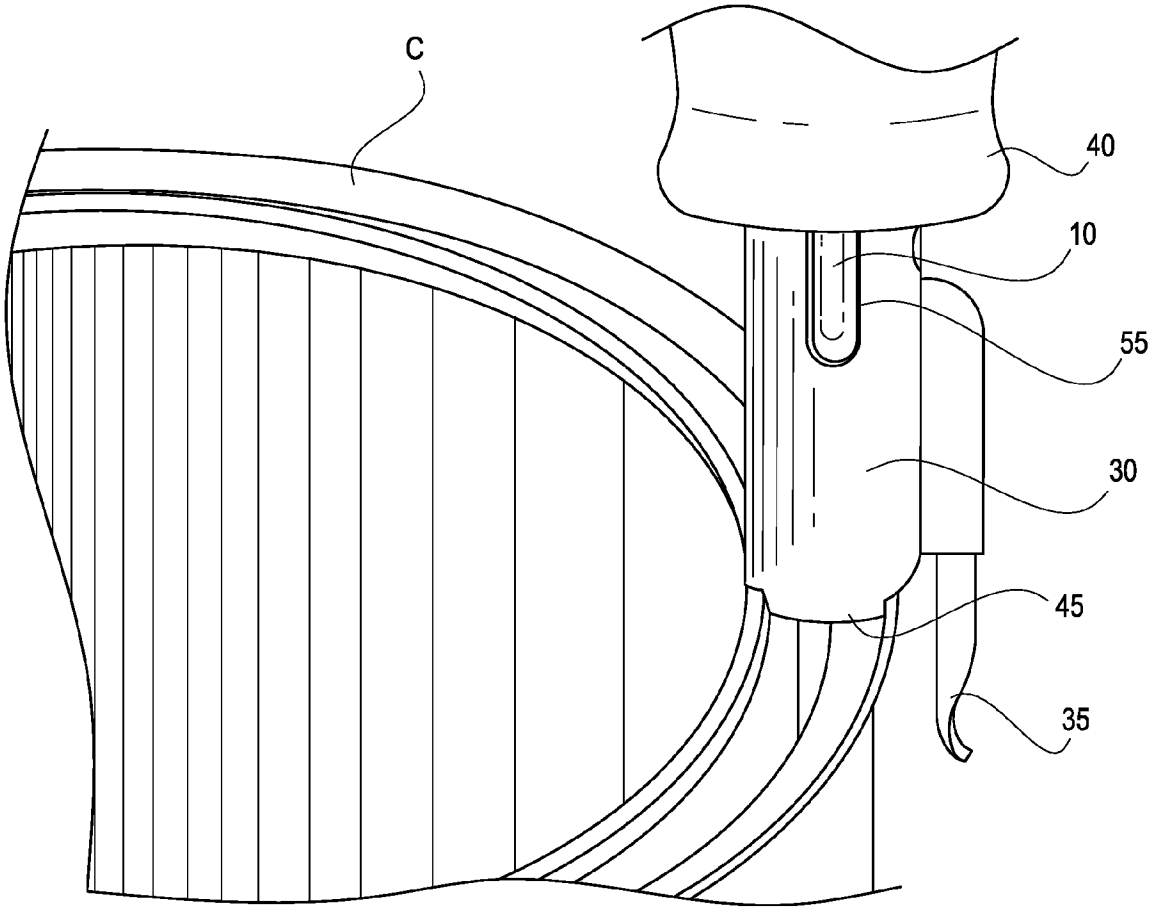
FIG. 7 depicts a perspective view of one embodiment of a multi-purpose paint can tool of the present invention in use with the at least one alignment notch being seated in the rim of a conventional paint can.
Figure 8:
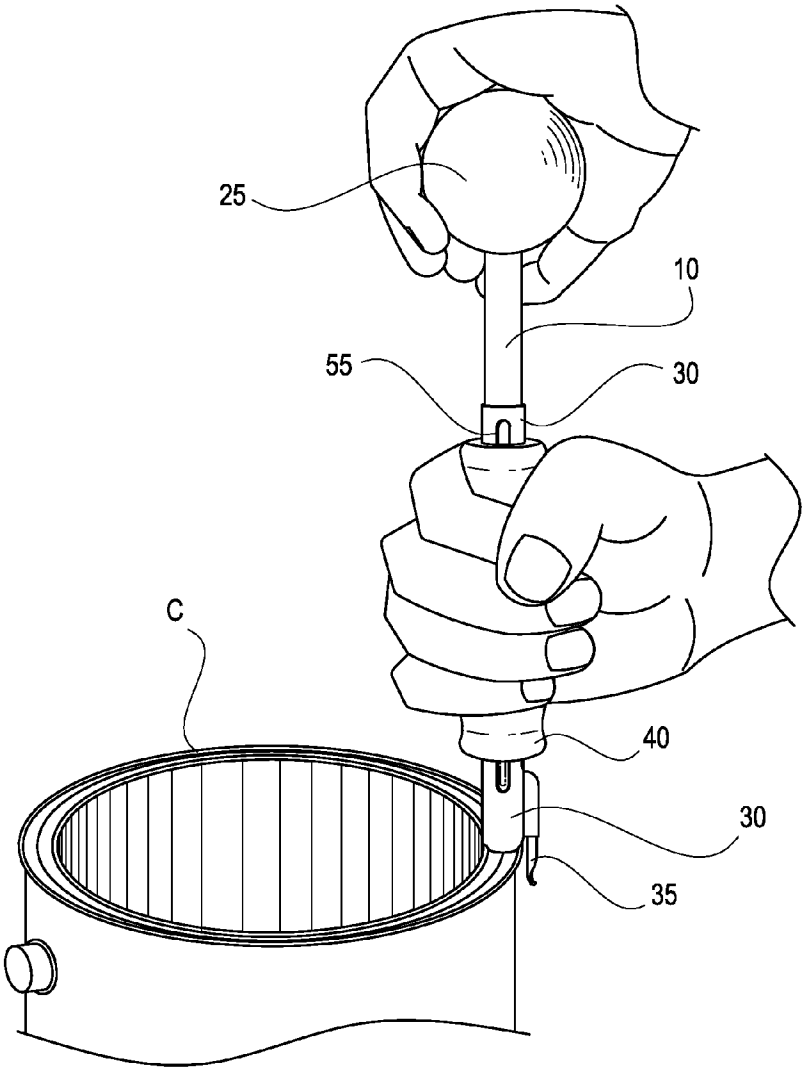
FIG. 8 depicts a perspective view of one embodiment of a multi-purpose paint can tool of the present invention in use with the at least one piercing spike and the piston shaft in a retracted position within the tubular housing.
Figure 9:
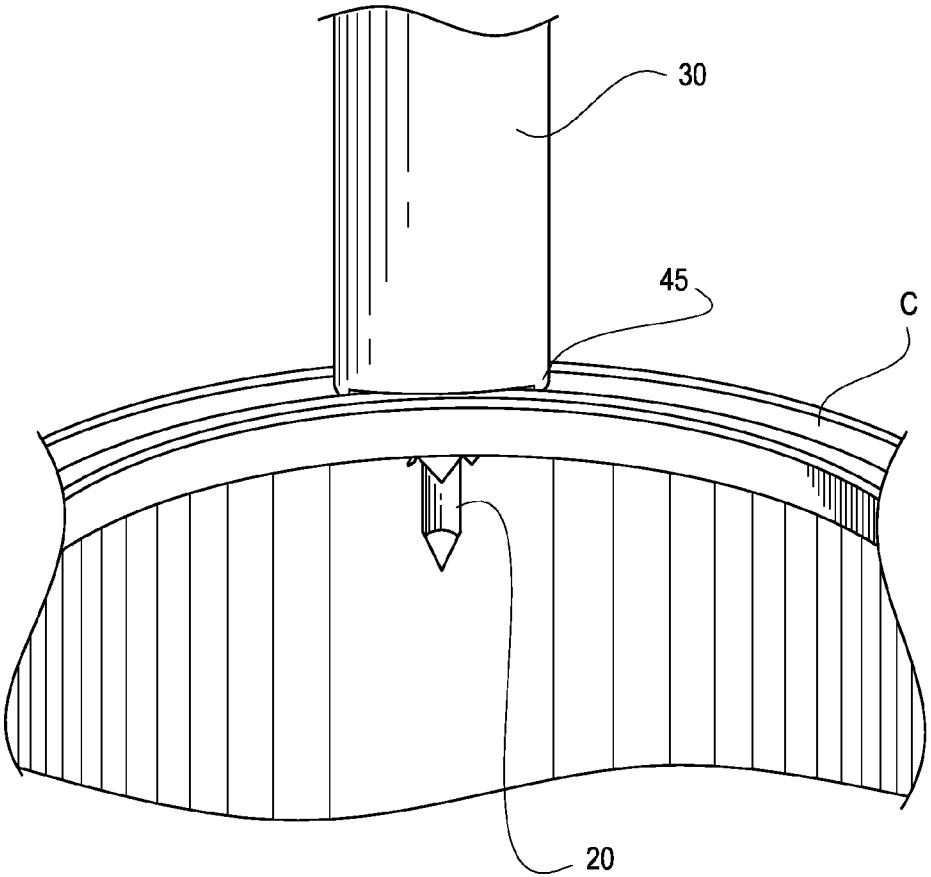
FIG. 9 depicts a perspective view of one embodiment of a multi-purpose paint can tool of the present invention in use wherein the at least one piercing spike is puncturing a hole in the rim of a conventional paint can.

The tubular housing 30, as best shown in FIGS. 7-9, may further comprise at least one alignment notch 45 disposed at the distal end of the tubular housing 30. The at least one alignment notch 45 holds the tubular housing 30 in the appropriate position within the rim of a conventional paint can C to allow for the at least one piercing spike 20 to create one or more drainage holes within the rim. The tubular housing 30 still further comprises a ball lock hole 50 and a tracking guide slot 55, each of which may interact with the spring-loaded ball lock 15 disposed within the piston shaft 10. The at least one alignment notch 45, the ball lock hole 50, and the tracking guide slot 55 may each independently be molded, cast or otherwise formed integrally with the tubular housing 30 from one piece of raw material during its primary manufacture, or alternatively, be machined or cut into the tubular housing 30 subsequent to its primary manufacture.

The piston shaft 10 and tubular housing 30 may be independently manufactured utilizing a variety of processes that may include but are not limited to molding, casting, CNC machining, laser-cutting, milling or lathing, and can be made of a variety of materials that include but are not limited to steel, iron, stainless steel, aluminum, any type of metal alloy, plastic polymers, composites, resins, other synthetic materials, or any combinations thereof. The piston shaft 10 and the associated tubular housing 30 may comprise round, square, triangular, or any other shape cross section that allows for the proper configuration of the functional elements of the present invention. Cross sectional shape is not a critical feature of the multi-purpose paint can tool 100 of the present invention and the only requirement is that the tool 100 accomplishes its intended functions such as axial piston shaft 10 movement within the tubular housing 30 for piercing at least one hole in the rim of a conventional paint can C.

FIGS. 6-10 illustrate a preferred method of use for the multi-purpose paint can tool 100 of the present invention. A user would first place a conventional paint can C on a firm and level surface such as a concrete floor. As shown in FIG. 6, the user may then use the can lid opening implement 35 disposed at the distal end of the tubular housing 30 to pry off and remove the paint can C lid. Next, as shown in FIG. 7-8, the user may then grip the tool 100 with one hand around the rubber or vinyl hand grip 40 with his or her other hand being placed around the gripping knob and lid tamping implement 25 disposed at the proximal end of the piston shaft 10. Such preferred hand positions enable maximum user control and paint can C stability during the subsequent rim channel piercing operation disclosed as follows.

As shown in FIG. 8, with the tubular housing 30 properly seated and secured in a vertical orientation on the rim of the conventional paint can C, the user may then pull upward on the lid tamping knob 25, thus raising the piston shaft 10 to its maximum height and proximal extension or range of travel within the tubular housing 30, while ensuring that the spring-loaded ball lock 15 disposed within the piston shaft 10 is visible at the top of the tracking guide slot 55 in the tubular housing 30. From this position, as shown in FIG. 9, a firm downward thrusting action applied by the user upon the lid tamping knob 25 motivates the piston shaft 10 through the tubular housing 30 and forces the at least one piercing spike 20 into and through the lowermost channel of the rim of the conventional paint can C, thus creating a hole in the rim channel equal in diameter to that of the at least one piercing spike 20.

The user may then be free to repeat this method or procedure any number of times, working his or her way around the circumference of the rim of the conventional paint can C to punch any number of desired holes at multiple locations about the rim to allow for drainage of excess paint accumulating in the paint can C rim back into the inside of the conventional paint can C throughout the painting session.

The matching of at least one alignment notch 45 and contours of the tubular housing 30 to the conventional paint can C rim, as well as the position and placement of the at least one piercing spike 20 in the end of the piston shaft 10 have been designed to enable the multi-purpose paint can tool 100 to function equally well with standard one-gallon and one-quart metal paint cans. The scope of the present invention may further comprise modifying the at least one alignment notch 45 and contours of the tubular housing 30 to accommodate the rims of any other conventional paint cans known within the art.

After the painting session has been completed using the multi-purpose paint can tool 100 of the present invention as described, the rim channels will be nearly free of the excess paint making the conventional paint can C ready for mess free re-sealing. As shown in FIG. 10, after positioning the lid back onto the conventional paint can C, the user need only position the multi-purpose paint can tool 100 in an essentially vertical position with the lid tamping knob 25 facing downward, so as to be able to use the lid tamping knob 25 to tamp down and seal the lid firmly back into the rim of the paint can C.

Finally, as shown in FIG. 1, for both the protection of the at least one piercing spike 20 and the safety of the user and others, a protective vinyl safety cap 60 may be pushed onto or otherwise over the tip of the at least one piercing spike 20. The piston shaft 10 may also be retracted into the tubular housing 30 to the point that the at least one piercing spike 20 is now enclosed within the tubular housing 30, and the spring-loaded ball lock 15 clicks into the ball lock hole 50. This locking action will ensure that the at least one piercing spike 20 remains safely retracted within the tubular housing 30 during storage of the multi-purpose paint can tool 100 until the next subsequent use of the tool 100 is desired.

What is claimed is:

1. A multi-purpose paint can tool, comprising:

a tubular housing having an inner diameter and an outer diameter, a piston shaft, a piercing spike, a can opening implement, a lid tamping knob, wherein lid tamping knob is larger than said inner diameter of said tubular housing, and a handle, wherein said piston shaft is slidingly engaged within said inner diameter of said tubular housing, and wherein said piercing spike is affixed to a distal end of said piston shaft and said lid tamping knob is affixed to a proximal end of said piston shaft, and wherein said can opening implement is affixed to a proximal end of said tubular housing, and wherein said handle is disposed about said tubular housing, wherein said piercing spike extends beyond the distal end of said tubular housing when said lid tamping knob contacts said proximal end of said tubular housing.

2. The multi-purpose paint can tool of claim 1, wherein said piston shaft further comprises a spring-loaded ball lock, and wherein said tubular housing further comprises a ball lock hole adapted to receive said spring-loaded ball lock, such that said piercing spike is completely retracted within said tubular housing when said spring-loaded ball lock is received by said ball lock hole.

3. The multi-purpose paint can tool of claim 2, wherein said tubular housing further comprises an alignment notch in said distal end of said tubular housing.

4. The multi-purpose paint can tool of claim 3, wherein said tubular housing further comprises a tracking guide slot disposed thereon which is adapted to receive said spring-loaded ball lock when said piston shaft slides within said tubular housing.

5. The multi-purpose paint can tool of claim 2, wherein said tubular housing further comprises a tracking guide slot disposed thereon which is adapted to receive said spring-loaded ball lock when said piston shaft slides within said tubular housing.

6. The multi-purpose paint can tool of claim 1, wherein said tubular housing further comprises a can opening element.

7. The multi-purpose paint can tool of claim 6, wherein said can opening element comprises a shaft having a proximal end and a distal end, wherein said distal end comprises a curved flattened tip, and wherein said can opening element shaft proximal end is affixed to said distal end of said tubular housing.

8. The multi-purpose paint can tool of claim 7, wherein said tubular housing further comprises an alignment notch in said distal end of said tubular housing.

9. The multi-purpose paint can tool of claim 8, wherein said tubular housing further comprises a tracking guide slot disposed thereon which is adapted to receive said spring-loaded ball lock when said piston shaft slides within said tubular housing.

10. The multi-purpose paint can tool of claim 7, wherein said tubular housing further comprises a tracking guide slot disposed thereon which is adapted to receive said spring-loaded ball lock when said piston shaft slides within said tubular housing.

11. The multi-purpose paint can tool of claim 6, wherein said tubular housing further comprises an alignment notch in said distal end of said tubular housing.

12. The multi-purpose paint can tool of claim 11, wherein said tubular housing further comprises a tracking guide slot disposed thereon which is adapted to receive said spring-loaded ball lock when said piston shaft slides within said tubular housing.

13. The multi-purpose paint can tool of claim 6, wherein said tubular housing further comprises a tracking guide slot disposed thereon which is adapted to receive said spring-loaded ball lock when said piston shaft slides within said tubular housing.

14. The multi-purpose paint can tool of claim 1, further comprising a handle disposed about said outer diameter of said tubular housing.

15. The multi-purpose paint can tool of claim 14, wherein said tubular housing further comprises an alignment notch in said distal end of said tubular housing.

16. The multi-purpose paint can tool of claim 15, wherein said tubular housing further comprises a tracking guide slot disposed thereon which is adapted to receive said spring-loaded ball lock when said piston shaft slides within said tubular housing.

17. The multi-purpose paint can tool of claim 16, further comprising a safety cap removably engaged on said piercing spike.

18. The multi-purpose paint can tool of claim 14, wherein said tubular housing further comprises a tracking guide slot disposed thereon which is adapted to receive said spring-loaded ball lock when said piston shaft slides within said tubular housing.

19. The multi-purpose paint can tool of claim 1, wherein said tubular housing further comprises an alignment notch in said distal end of said tubular housing.

20. The multi-purpose paint can tool of claim 19, wherein said tubular housing further comprises a tracking guide slot disposed thereon which is adapted to receive said spring-loaded ball lock when said piston shaft slides within said tubular housing.

21. The multi-purpose paint can tool of claim 1, wherein said tubular housing further comprises a tracking guide slot disposed thereon which is adapted to receive said spring-loaded ball lock when said piston shaft slides within said tubular housing.

* * * * *